US012791024B2

(12) United States Patent
Rapp

(10) Patent No.: US 12,791,024 B2
(45) Date of Patent: Nov. 10, 2026

(54) PUMP

(71) Applicant: Gebr. Becker GmbH, Wuppertal (DE)

(72) Inventor: Michael Rapp, Solingen (DE)

(73) Assignee: Gebr. Becker GmbH, Wuppertal (DE)

( * ) Notice: Subject to any disclaimer, the term of this patent is extended or adjusted under 35 U.S.C. 154(b) by 0 days.

(21) Appl. No.: 19/271,907

(22) Filed: Jul. 17, 2025

(65) Prior Publication Data

US 2026/0309152 A1 Oct. 8, 2026

(30) Foreign Application Priority Data

Apr. 8, 2025 (DE) ..... 10 2025 113 776.5
May 9, 2025 (DE) ..... 10 2025 117 862.3

(51) Int. Cl.
*F04C 18/344* (2006.01)
*F04C 29/00* (2006.01)

(52) U.S. Cl.
CPC ..... *F04C 18/3441* (2013.01); *F04C 29/0092* (2013.01); *F04C 2240/30* (2013.01)

(58) Field of Classification Search
CPC ..... F04C 18/3441; F04C 29/0092; F04C 2240/30
See application file for complete search history.

(56) References Cited

U.S. PATENT DOCUMENTS

2007/0059195 A1 3/2007 Patterson
2018/0142554 A1* 5/2018 Kraft ..... F04C 25/02
2022/0356880 A1* 11/2022 Beierlein ..... F01C 21/0809

FOREIGN PATENT DOCUMENTS

CN 2069937 U * 1/1991
DE 10330541 A1 * 2/2005 ..... F04C 18/3446
JP H09209940 A * 8/1997
WO 2021/001421 A1 1/2021

OTHER PUBLICATIONS

English Translation DE-10330541-A1 (Year: 2005).*
English Translation JP-H09209940-A (Year: 1997).*
English Translation CN-2069937-U (Year: 1991).*

* cited by examiner

*Primary Examiner* — Shafiq Mian
(74) *Attorney, Agent, or Firm* — Collard & Roe, P.C.

(57) ABSTRACT

A pumping device has a rotary slide assembly that includes a rotary slide chamber formed in a rotary slide housing and a rotary slide rotor arranged in the rotary slide chamber and rotatable about an axis of rotation. The rotary slide chamber has a stationary wall, a circumferential wall and opposing sidewalls. A rotary slide receptacle for a slide is formed in the rotary slide rotor. The slide has first and second outer edges in the direction of the axis of rotation and third and fourth outer edges transverse to the axis of rotation. The slide is accommodated in the rotary slide receptacle so as to be essentially movable radially with respect to the axis of rotation, and interacts with the slide receptacle in a form-fitting manner between the third and fourth outer edges in order to prevent movement of the slide in a direction of the axis of rotation.

11 Claims, 5 Drawing Sheets

PUMP

CROSS REFERENCE TO RELATED APPLICATIONS

Applicant claims priority under 35 U.S.C. § 119 of German Application No. 10 2025 113 776.5 filed Apr. 8, 2025 and German Application No. 10 2025 117 862.3 filed May 9, 2025, the disclosures of which are incorporated by reference.

BACKGROUND OF THE INVENTION

1. Field of the Invention

The invention relates to a pumping device with a rotary slide assembly, wherein the rotary slide assembly comprises a rotary slide chamber that is formed in a rotary slide housing and a rotary slide rotor that is arranged in the rotary slide chamber and rotatable about an axis of rotation, wherein the rotary slide chamber has a wall that is stationary relative to the rotary slide rotor, a circumferential wall and opposing sidewalls, wherein a rotary slide receptacle for a slide furthermore is formed in the rotary slide rotor, wherein the slide has a first and a second outer edge in the direction of the axis of rotation and a third and a fourth outer edge transverse to the axis of rotation, and wherein the slide furthermore is accommodated in the rotary slide receptacle so as to be essentially movable radially with respect to the axis of rotation.

2. Description of the Related Art

US 2007/0059195 A1 discloses a pumping device with a rotary slide assembly, in which the sidewalls are designed so as to rotate together with the rotary slide rotor. In addition to being guided by the slide receptacles in the rotor, the slides also move in groove-shaped recesses on their outer edges facing the sidewalls.

Pumping devices of the initially described type have also been disclosed in various respects.

WO 2021/001421 A1 (US 2022/0 356 880 A1) discloses a rotary slide assembly, in which the circumferential wall and the sidewalls are stationary relative to the rotor. The slides are accommodated in guide slots, which have opposing guide slot walls that extend parallel to one another and are realized in a continuously planar manner. The cross section of the slides is adapted thereto such that they are freely movable radially in the aforementioned radial direction, wherein the receptacle slots and therefore also the moving directions of the slides include an acute angle with a radial in this known rotary slide assembly.

A rotary slide assembly of this type is also known, for example, from DE 103 30 541 A1, wherein the slide receptacles and accordingly the movements of the slides extend strictly radially.

It is intended that the slides move relative to the circumferential wall, but also relative to the sidewalls, such they are sealed as best as possible during the operation of the pumping device. With respect to the circumferential wall, the leading edges of the slides are pressed against the circumferential wall due to the rotational movement of the rotary slide rotor. With respect to the sidewalls, which always extend perpendicular to the axis of rotation, it is intended to achieve the smallest gap possible. On the other hand, it can occur that a slide is during the operation stressed in the direction of one or the other sidewall, e.g. due to pressure ratios in the pumping device, wherein this can also lead to corresponding wear and to an increased gap loss on at least one side.

SUMMARY OF THE INVENTION

Based on the above-described prior art, the invention aims to disclose a pumping device with a rotary slide assembly, in which the smallest gap loss possible can be achieved during the operation of the pumping device. The invention additionally or independently aims to disclose a pumping device that is particularly advantageous for operation with a vertical axis of rotation.

It is proposed that the slide interacts with the rotary slide receptacle in a form-fitting manner in order to prevent a movement of the slide in a direction of the axis of rotation.

In this case, the rotary slide receptacle provides a form-fitting interaction for not only specifying an—at least essentially—radial movement of the slide, but at the same time also for specifying a potential movement of the slide in the direction of the axis of rotation in the sense that this potential movement is prevented. In this way, the slide can advantageously maintain the smallest gap dimension possible relative to the sidewalls and does not interact with one or both sidewalls such that wear occurs.

The interaction of the slide with the rotary slide receptacle as a result of a form fit is realized within the extent of the slide in the direction of the axis of rotation within the slide receptacle.

For this purpose, the slide may have a form fit projection and the rotary slide receptacle may have a form fit recess. It is furthermore preferred that the form fit projection is realized in the form of a form fit bead and the form fit receptacle is realized in the form of a form fit groove that is essentially or completely adapted to the form fit bead.

The form fit projection, as well as the form fit recess, extends radially or essentially radially to the axis of rotation. Accordingly, they preferably are penetrated by a geometric plane extending perpendicular to the axis of rotation over their length, over which they interact with one another.

It would also be possible, in principle, to reverse this arrangement such that the slide has the form fit recess and the rotary slide receptacle has the form fit projection. Since this requires weakening of a wall thickness of the slide, i.e. a dimension of the slide in the circumferential direction to the axis of rotation, or complicated shaping, however, this design is only advantageous for use in exceptional instances.

The described design of the form-fitting interaction between the slide and the rotary slide receptacle in the direction of the axis of rotation is also of particular importance if the axis of rotation of the rotary slide assembly is aligned vertically in the operative state. The force of gravity acting upon the slide results in a stress in the direction of at least the lower sidewall in this type of installation. Without the described measure, this would tend to result in a wear-promoting interaction between an associated lower slide edge and the sidewall.

The rotary slide rotor may be realized with two or more rotary slide receptacles, wherein one slide may be accordingly arranged in each of the rotary slide receptacles, i.e. a total of two or more slides may be provided. All slides can interact with the rotary slide receptacle in a form-fitting manner as described above. The rotary slide receptacles preferably are formed at identical circumferential angular distances.

In a pumping device with a rotary slide assembly, in which the rotary slide assembly comprises a rotary slide chamber that is formed in a rotary slide housing and a rotary slide rotor that is arranged in the rotary slide chamber and rotatable about an axis of rotation, it is preferred, particularly with respect to an arrangement of the pumping device with a vertical axis of rotation of the rotary slide assembly and, if applicable, with a design according to one of the embodiments of the slide guidance described above and below, that the pump housing is realized in two or more parts, wherein a suction line with a suction filter and an outlet line with an outlet filter and preferably a first outlet valve are accommodated in a first housing part in addition to the rotary slide rotor whereas an outlet chamber with a second and, if applicable, a third outlet valve is accommodated in a second housing part.

The second housing part preferably is also arranged underneath the first housing part in the direction of the axis of rotation-referred to a vertical alignment of the axis of rotation. It may form a (lower) cover of the rotary slide chamber. In this respect, the second housing part may at the same time also form one of the sidewalls of the rotary slide chamber, namely the lower sidewall in the described instance.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the Drawings.

DETAILED DESCRIPTION OF PREFERRED EMBODIMENTS

A pumping device 1, which in the present exemplary embodiment preferably operates in the form of a vacuum pump, is illustrated in the figures and described below.

Figure 3:
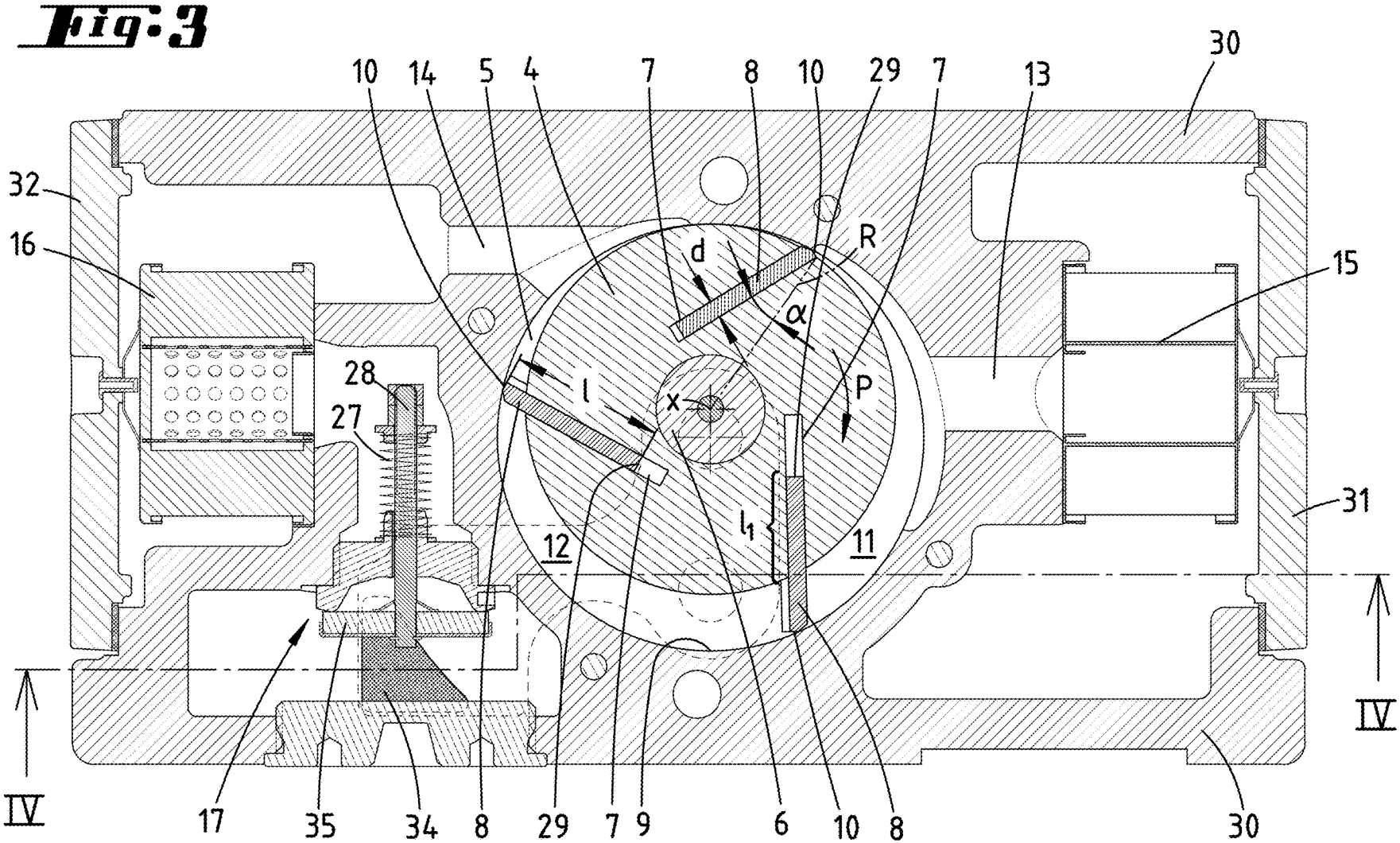
FIG. 3 shows a cross section through the object according to FIG. 2 along the plane III-III.
Figure 4:
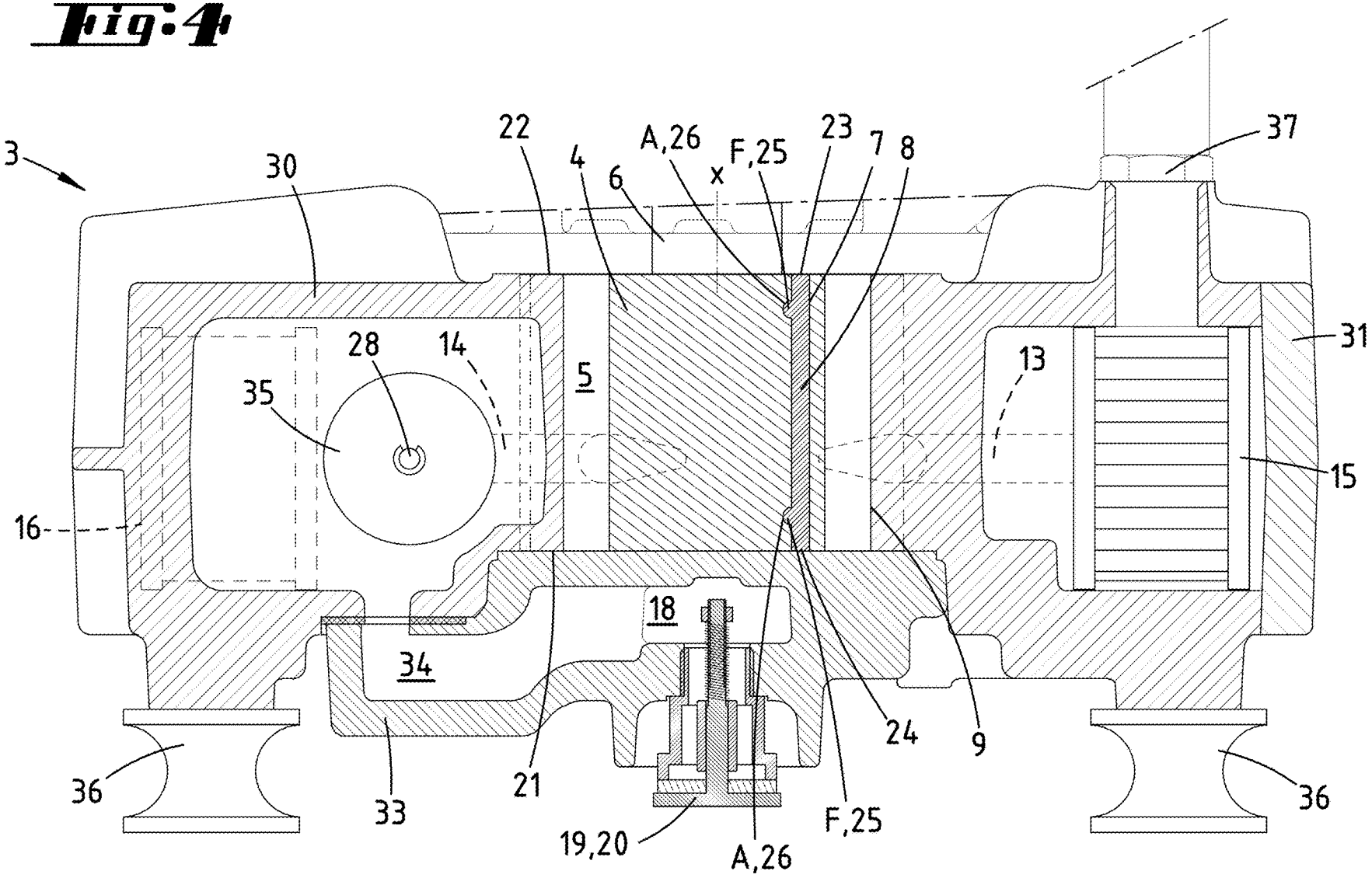
FIG. 4 shows a cross section through the object according to FIG. 2 and according to FIG. 3 along the plane IV-IV in FIG. 3.

The pumping device 1 has a motor 2, which in this case is realized in the form of an electric motor. It furthermore has a rotary slide assembly 3 that is illustrated in FIGS. 3 and 4 and comprises a rotary slide rotor 4 arranged in a rotary slide chamber 5.

The rotary slide rotor 4 has a geometric axis of rotation x, about which the rotary slide rotor is rotationally driven by means of a driveshaft 6 of the motor 2.

The rotary slide rotor 4 preferably is realized in the form of an essentially cylindrical body, wherein rotary slide receptacles 7 for slides 8, which essentially are aligned radially to the axis of rotation x, are formed in said cylindrical body.

The slides 8 have a first and a second outer edge 10, 29 in the direction of the axis of rotation x and a third and a fourth outer edge 23, 24 transverse to the axis of rotation x.

It is likewise preferred that the rotary slide chamber 5 is realized with a cylindrical circumferential wall 9 as illustrated in the exemplary embodiment. The rotary slide rotor 4 is arranged eccentrically in the rotary slide chamber 5. The slides 8, which are arranged in the rotary slide receptacles 7 in an essentially radially movable manner, are pressed against the circumferential wall 9 with their first outer edge 10 due to the centrifugal force acting during the rotation of the rotary slide rotor 4, if applicable with partial assistance of the gravitational force. This results in hollow spaces 11, 12, etc. that are separated from one another by the slides 8 and, due to the eccentric arrangement of the rotary slide rotor 4 and the retraction and extension of the slides 8 referred to the rotary slide receptacle 7, respectively become smaller or larger during the rotation of the rotary slide rotor 4.

In the exemplary embodiment, the rotary slide rotor 4 rotates in the direction of the arrow P during the operation of the pumping device. A gas, particularly air or, if applicable, air that is already subjected to a vacuum, is drawn in through an inlet 13, wherein the gas being drawn in is compressed to the hollow space 12 due to the rotation of the rotary slide rotor 4 and the associated volume reduction of the hollow space 11 and then discharged again through an outlet 14. In the exemplary embodiment, the hollow space 12 subsequently is practically reduced to zero and then enlarged again toward the inlet 13. Whenever "air" is mentioned above and below, this also respectively includes the more general term "gas."

An inlet filter 15, by means of which the air being drawn in can initially be filtered, may be arranged upstream of the inlet 13.

An outlet filter 16, by means of which the outlet air also can be filtered once again, furthermore may be arranged downstream of the outlet 14. The outlet air can then be conveyed into an outlet chamber 18 via a first outlet valve 16 and discharged via a second and, if applicable, a third outlet valve 19, 20.

Figure 1:
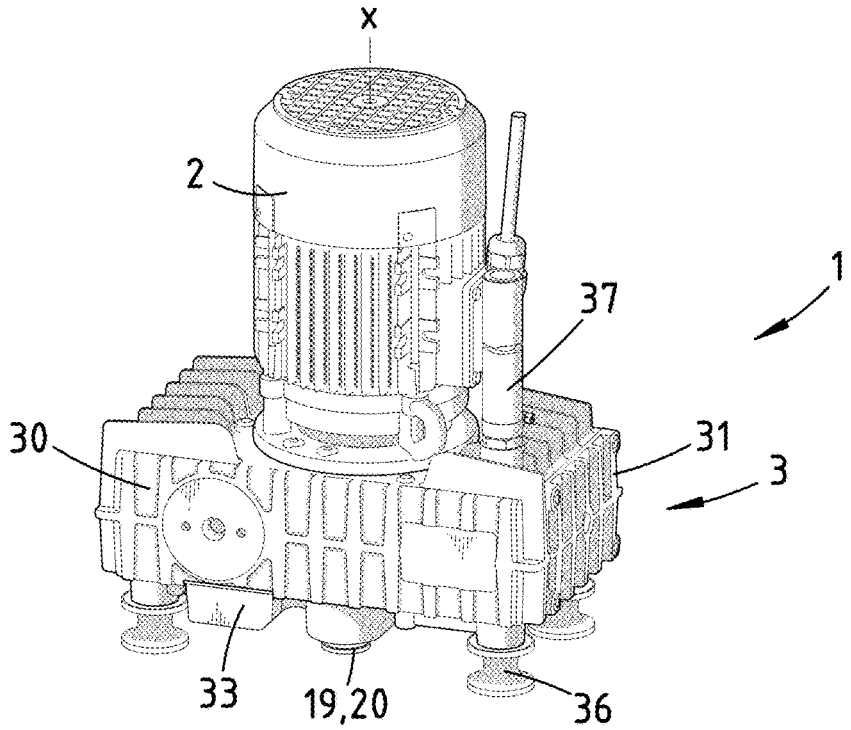
FIG. 1 shows a perspective overall view of a pumping device with a rotary slide assembly.
Figure 2:
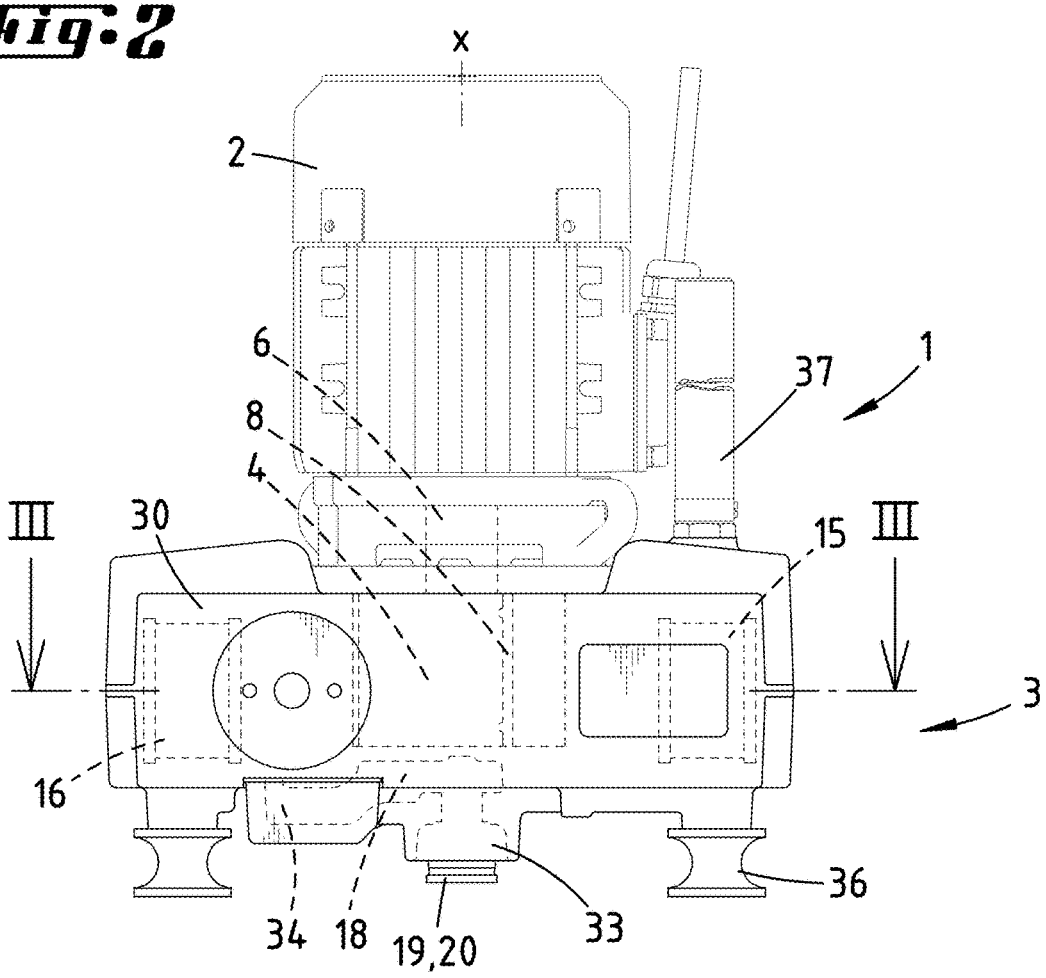
FIG. 2 shows a front view of the pump slide assembly according to FIG. 1.

In any case, the exemplary embodiment illustrated in FIGS. 1 and 4 shows that the rotary slide assembly 3 preferably is arranged such that the axis of rotation x extends vertically.

The circumferential wall 9 is closed on its upper and lower sides in the direction of the axis of rotation x by means of a lower sidewall 21 and an upper sidewall 22. A slide 8 is guided relative to the lower sidewall 21 and the upper sidewall 22 with a preferably very small gap dimension that is not visible in the drawings.

For this purpose, the slide 8 has a form fit formation F that is accommodated in a form fit recess A of the rotary slide receptacle 7. In this way, the slide 8 is guided in the rotary slide receptacle 7 in a form-fitting manner. It is thereby prevented from carrying out a movement in the direction of the axis of rotation x. The form fit formation F particularly may be a form fit bead 25 and the form fit recess A particularly may be a form fit groove 26. The rotary slide receptacle 7 extends at an acute angle $\alpha$ to a radius line R.

A slide 8 may consist of different materials. It may particularly consist of a plastic material or also of a graphite material. There is a distinction between dry running and oil-lubricated rotary slide assemblies. Slides of a graphite material preferably are used in dry running rotary slide assemblies whereas slides of a plastic material preferably are used in oil-lubricated rotary slide assemblies.

Due to the constant interaction between the first outer edge 10 of the slides 8 and the circumferential wall 9 during a pumping operation, the slides 8 are constantly subjected to wear such that the slides 8 wear down in their extending direction and are also extended farther from the rotary slide receptacle 7 as their operating time increases. The slides can be monitored for such wear and, if necessary, replaced in a timely manner, wherein we refer to initially cited publication WO 2021/001 421 A1 in this respect.

Figure 6:
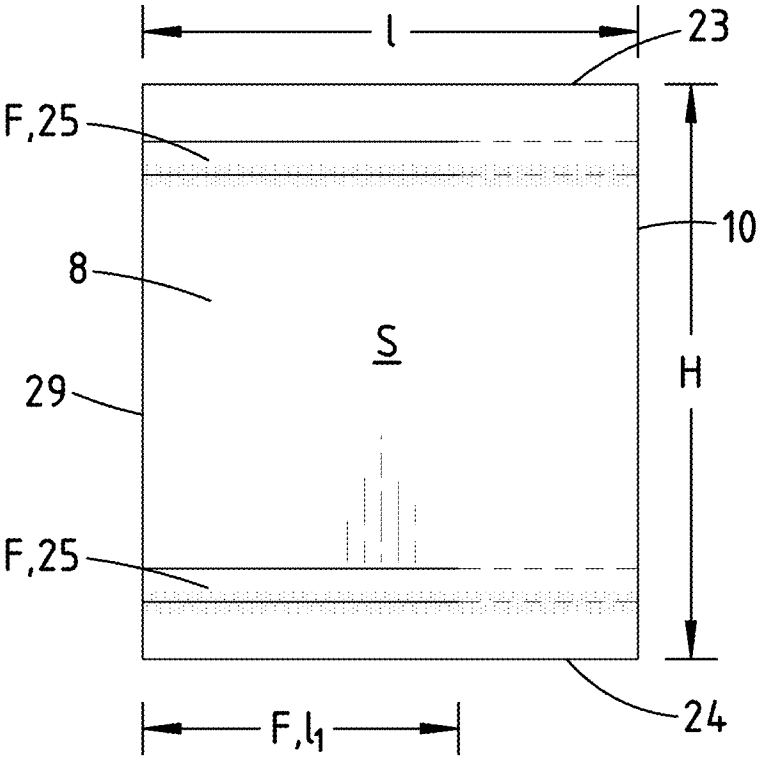
FIG. 6 shows a top view of the slide viewed at the side with guide formations.
Figure 5:
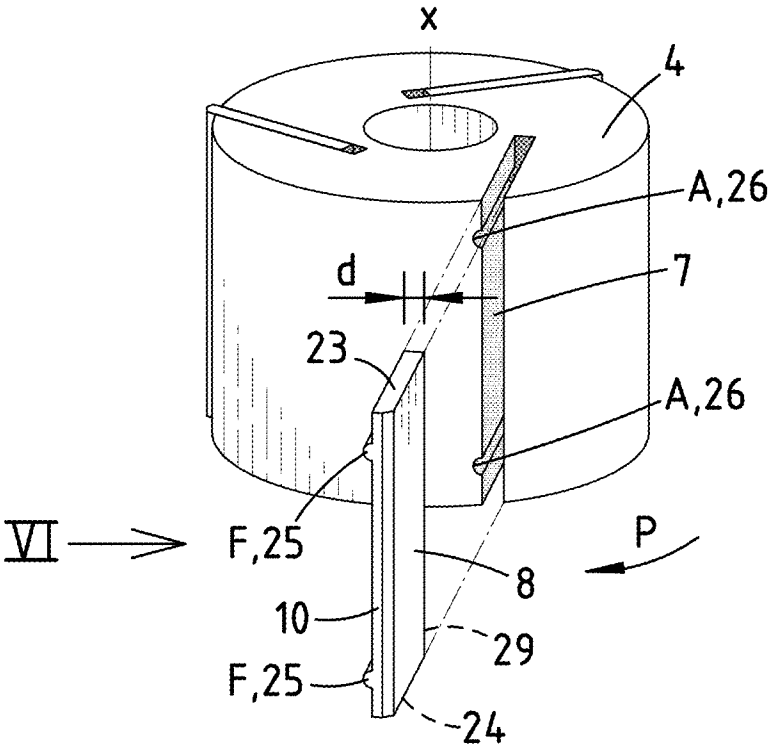
FIG. 5 shows a perspective view of the rotor only.

FIGS. 5 and 6 show that a slide 8 preferably is an essentially rectangular, comparatively flat component that has a length I measured in the extending direction and a thickness d measured perpendicular thereto. The length I is 5-times greater than the thickness d or longer and may be as long as 20-times or 30-times greater than this thickness or longer. Accordingly, a slide 8 has a first and a second longitudinal side S, which are comparatively large and lie opposite of one another, and first and second narrow sides that are respectively assigned to the first and the second outer edge 10, 29, wherein a slide furthermore has third and fourth narrow sides that are respectively assigned to the third, upper and the fourth, lower outer edges 23, 24. The first and the second outer edge 10, 29 essentially extend parallel to the axis of rotation x whereas the lower and the upper outer edge 23, 24 extend transverse to the axis of rotation x.

According to the design disclosed herein, however, a form fit formation F is provided on such a longitudinal side S within a height H of a slide 8. The form fit formation F is realized so as to extend in the direction of the length I and preferably formed at a distance from the upper outer edge 23 and the lower outer edge 24—referred to the preferred arrangement of the rotary slide rotor 4 with a vertical axis of rotation x. The distance may correspond to a thickness d of the slide 8 or be greater than this thickness. It is preferred that the form fit formation F and preferably also the form fit recess A extend parallel to the third and/or fourth outer edge 23, 24.

It is furthermore preferred that the form fit formation F is realized in the form of a form fit bead 25 as illustrated in the exemplary embodiment. It therefore protrudes from the remaining longitudinal side S of the slide 8.

The form fit formation F accordingly is provided for functionally interacting with the form fit recess A, which preferably is realized in the form of a form fit groove 26. In this way, the slide 8 can be advantageously held in the vertical direction-referred to the preferred vertical axis of rotation x. The aforementioned gap dimension between the third and the fourth outer edge 23, 24 and the upper and/or lower sidewall 21, 22 can thereby be kept essentially constant over the service life of a slide 8.

It is furthermore preferred that the form fit recess A is realized in the form of a negative design of the form fit formation F, i.e. it is preferably realized in the form of a form fit groove 26 that is adapted to the form fit bead 25.

The form fit formation F preferably is made of the same material as the remaining slide 8. In this respect, the slide 8 is also made of a consistently uniform material in this embodiment.

With respect to the manufacturing technology, the form fit formation F can be produced-preferably together with the remaining slide 8—in different ways. It may be produced by means of sintering, but may also be produced in an injection molding process or a corresponding element may be bonded to the remaining slide.

The use of an adhesive naturally would also result in an additional material.

The form fit formation F may be provided on one side of a slide 8, namely on the longitudinal side S of this slide 8 and accordingly only on this longitudinal side S of the slide 8, or also on both sides. Multiple form fit formations F, e.g. two form fit formations, may also be arranged on top of one another on the same slide-once again viewed in the direction of the preferred vertical axis of rotation. This multiple arrangement of form fit formations may also be realized on both longitudinal sides S, i.e. opposite of one another on the slide 8.

The form fit formation F and preferably also the form fit recess A, in this case the form fit bead 25 and the form fit groove 26, have a comparatively small width in the direction of the axis of rotation x and preferably also the consistently same width transverse to the direction of the axis of rotation x. This width may also correspond to (only) a thickness d of the slide 8 or less and may be as small as, for example, one-tenth of the thickness d. However, this thickness may also correspond to more than the thickness d of the slide 8 and be as large as, for example, ten-times the thickness d of the slide 8 or greater.

In this case, the form fit formations F may be arranged opposite of one another symmetrically with respect to a longitudinal central plane of the slide 8 or oppositely arranged offset to one another in the direction of the axis of rotation x of the rotary slide rotor 4.

A form fit formation F preferably is not realized over the entire length I of the slide 8, but rather only over a partial length I1, which is also still accommodated in the slide receptacle 7 when the slide 8 is radially extended as far as possible. It is furthermore preferred that the form fit formation F can be realized continuously as far as the second, rear outer edge 29 of the slide 8.

The form fit formation F of the rotary slide rotor 4 preferably is realized over essentially the entire radial length of the slide receptacle 7. In any case, it is preferably realized over the radial length of the slide receptacle 7, over which the slide 8 interacts with the slide receptacle.

A preferred construction of the rotary slide assembly 3, which may also be important without the described realization of the slide 8 with a form fit formation and of the slide receptacle with a form fit recess, is described below with reference to FIGS. 3 and 4.

The rotary slide assembly 3 initially has a rotary slide housing in the form of a first housing part 30. In any case, the rotary slide chamber 5 preferably is formed in the first housing part 30 and the rotary slide rotor 4 with the slides 8 is accommodated in this first housing part. Furthermore, the first housing part 30 preferably has the inlet 13 and the outlet 14, as well as a receptacle for the inlet filter 15 and the outlet filter 16. The first housing part 30 may be produced integrally, for example, in the form of a metallic casting.

A second housing part 31 and a third housing part 32 preferably form lateral housing parts that essentially extend vertically in the form of plate parts in the preferred arrangement of the rotary slide assembly 3 with vertical rotor axis. They can be removed in order to gain access to the inlet filter 15 and the outlet filter 16. They may also respectively provide an additional mounting for one or both of these filters.

A connecting part 33 may be provided as cover part with respect to a first outlet valve 34. It extends in a surface area essentially perpendicular to the second and the third housing part 31, 32. In the arrangement of the rotary slide assembly 3 with vertical axis of rotation x, this concerns a downwardly sealing cover such that it can also be referred to as a bottom.

The first outlet valve 17 may be realized in the form of a disk valve that can be displaced against a spring 27 and has a valve disk 35. A valve shaft 28 of the first outlet valve 17 preferably extends perpendicular to the axis of rotation x, i.e. horizontally. The valve disk 35 is arranged on the valve shaft 28 and the spring 27 acts upon the valve disk 35 via the valve shaft 28 in order to prestress the valve disk into a closed position.

It is furthermore preferred that the connecting part 33 has a deflection chamber 34 that essentially extends vertically in the flow direction, wherein air exiting the outlet 14 is conveyed into the outlet chamber 18 by means of said deflection chamber as illustrated in FIG. 4, preferably after having passed through the outlet filter 16 and the first outlet valve 17.

It is furthermore preferred that the outlet chamber 18 is formed in the connecting part 33, which preferably closes the rotary slide chamber 5 from below similar to a cover in the above-described manner. In this way, the connecting part 33 can form the lower sidewall 21 of the rotary slide chamber 5.

Furthermore, the second outlet valve 19 and, if applicable and as in the exemplary embodiment, the third outlet valve 20 preferably are arranged in the connecting part 33. The second outlet valve 19 and, if applicable, the third outlet valve 20 may be designed identically to the first outlet valve 17. The longitudinal axes of the relevant valve stems preferably are oriented parallel to the axis of rotation x in this case.

The housing part having the housing chamber 18 and/or the second housing part 31 and/or the third housing part 32 may also be metallic parts, particularly metallic castings. The connecting part 33 may likewise be a metallic part, e.g. a casting such as a gray cast iron casting. However, the connecting part 33 may also be a plastic part because this part does not have to absorb significant forces and is not subjected to considerable wear. On the other hand, a plastic part can be advantageously shaped and provides weight savings.

Once significant wear has occurred on a form fit formation F or a form fit bead 25 toward the end of the service life of a slide 8, a lower narrow side or a lower outer edge 24 may come in contact with the facing surface of the connecting part 33. In light of these circumstances, a plastic material such as PTFE (polytetrafluoroethylene), optionally modified PTFE/TFM (polytetrafluoroethylene (modified)), or PBI (polybenzimidazole), PEI (polyetherimide) and/or PA (polyamide), particularly PA4.6, may be considered for the connecting part 33.

These materials provide a desired high temperature resistance and/or good sliding properties and/or low abrasion. The second and/or the third housing part 31, 32 may also be made of such a material.

A coating may be provided if the second and/or third housing part 31, 32 or the connecting part 33 consist of a metallic material such as gray cast iron. The coating may serve for improving the sliding properties and/or for improving the abrasion resistance. The coating material preferably is chosen such that it also has a high temperature resistance. The coating material particularly may consist of one of the above-described plastics. However, it may also be a metallic coating material.

Figure 7:
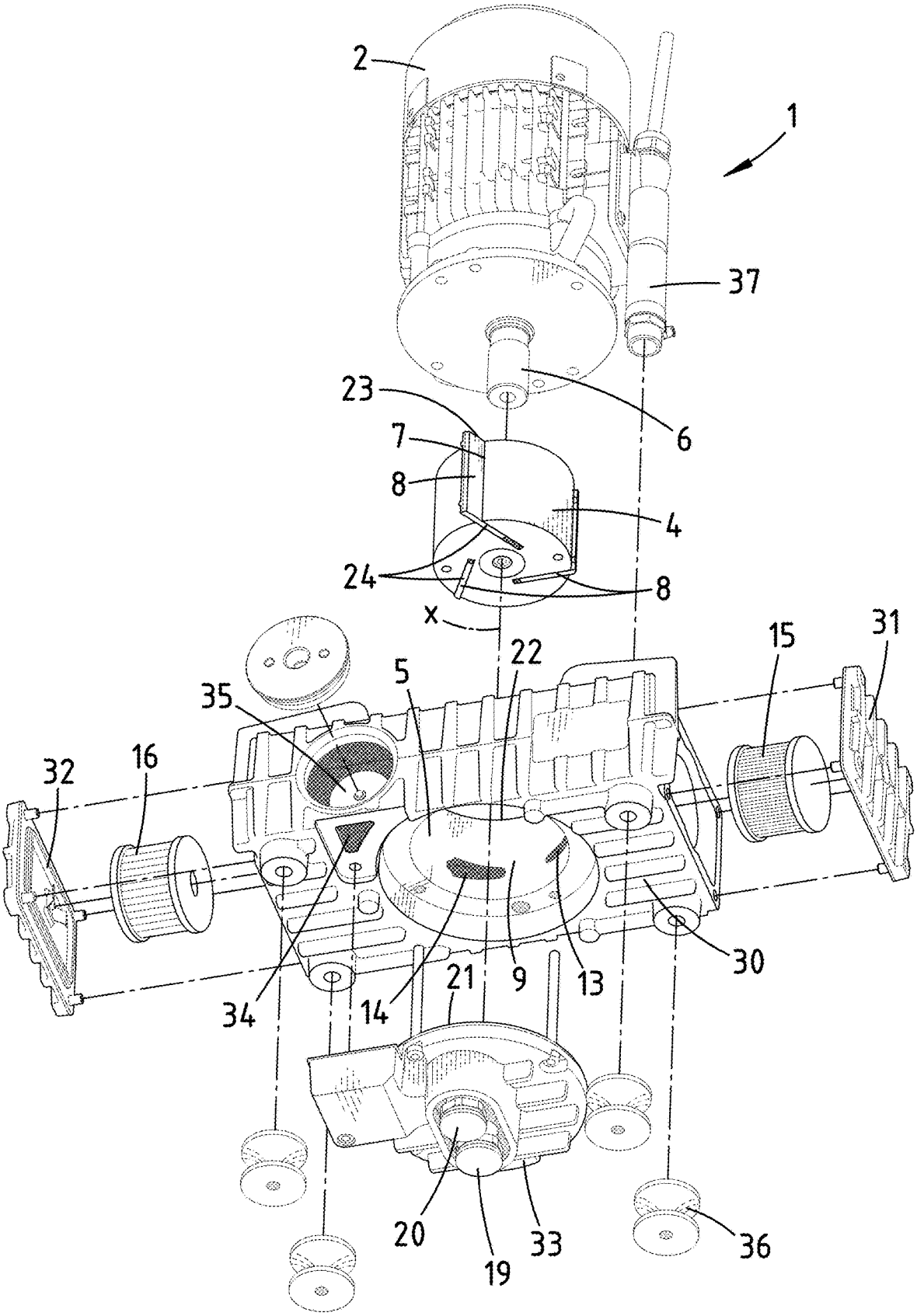
FIG. 7 shows an exploded view of the pumping device.

The exploded view in FIG. 7 furthermore shows that the pumping device 1 preferably has on its underside multiple legs 36 that may also be designed for providing a certain damping effect. The legs 36 preferably are arranged on the underside of the housing part 30.

The inlet 30 may be connected to an inlet line 37, by means of which a chamber to be subjected, for example, to a negative pressure or a vacuum can be connected. The inlet line 37 may extend along the motor 2. Air drawn in through the inlet line 37 is conveyed in such a way that it initially passes through the inlet filter 15 and subsequently can flow into the rotary slide chamber 5 through the inlet 13.

The design of the connecting part 33 with the outlet chamber 18 and the optional second and third outlet valve allows advantageous maintenance. When the connecting part 33 is removed, not only the first outlet valve 17 is accessible for maintenance, but also the second and, if applicable, the third outlet valve 19, 20, as well as the outlet chamber 18.

Similarly, the second and third housing parts 31, 32 are also advantageous with respect to the accessibility of relevant components of the rotary slide assembly 3.

Although only a few embodiments of the present invention have been shown and described, it is to be understood that many changes and modifications may be made thereunto without departing from the spirit and scope of the invention.

LIST OF REFERENCE SYMBOLS

1 Pumping device
2 Motor
3 Rotary slide assembly
4 Rotary slide rotor
5 Rotary slide chamber
6 Driveshaft
7 Rotary slide receptacle
8 Slide
9 Circumferential wall
10 First outer edge
11 Hollow space
12 Hollow space
13 Inlet
14 Outlet
15 Inlet filter
16 Outlet filter
17 First outlet valve
18 Outlet chamber
19 Second outlet valve
20 Third outlet valve
21 Lower sidewall
22 Upper sidewall
23 Upper outer edge
24 Lower outer edge
25 Form fit bead
26 Form fit recess
27 Spring
28 Valve shaft
29 Second outer edge
30 First housing part
31 Second housing part
32 Third housing part
33 Connecting part
34 Deflection chamber
35 Valve disk
36 Leg
37 Inlet line
d Thickness
I Length
I1 Partial length
X Axis of rotation
A Form fit recess F Form fit formation
H Height
P Arrow
R Radius line
S Longitudinal side
α Angle

What is claimed is:

1. A pumping device having a rotary slide assembly comprising:

a rotary slide chamber that is formed in a rotary slide housing and a rotary slide rotor that is arranged in the rotary slide chamber and is rotatable about an axis of rotation, wherein the rotary slide chamber has a wall that is stationary relative to the rotary slide rotor, a circumferential wall and opposing sidewalls, wherein a rotary slide receptacle for a slide is formed in the rotary slide rotor, wherein the slide has a first outer edge and a second outer edge in a direction of the axis of rotation and a third outer edge and a fourth outer edge transverse to the axis of rotation, wherein the slide is accommodated in the rotary slide receptacle so as to be essentially movable radially with respect to the axis of rotation, and wherein the slide interacts with the slide receptacle in a form-fitting manner between the third outer edge and the fourth outer edge within the rotary slide receptacle in order to prevent a movement of the slide in a direction of the axis of rotation, and wherein the slide has a form fit formation and the rotary slide receptacle has a form fit recess for accommodating the form fit formation, the form fit formation and the form fit recess being configured to engage one another so as to prevent a movement of the slide in the direction of the axis of rotation relative to the rotary slide rotor.

2. The pumping device according to claim 1, wherein the axis of rotation is aligned vertically in an installed state of the rotary slide assembly.

3. The pumping device according to claim 1, wherein the rotary slide receptacle is oriented radially to the axis of rotation.

4. The pumping device according to claim 1, wherein the rotary slide receptacle includes an acute angle with a radial originating from the axis of rotation.

5. The pumping device according to claim 1, wherein two or more of the rotary slide receptacles are formed in the rotary slide rotor and/or wherein two or more of the slides are provided.

6. The pumping device according to claim 1, further comprising a connecting part arranged underneath the rotary slide rotor, the connecting part forming a lower of the sidewalls of the rotary slide chamber.

7. The pumping device according to claim 1, wherein an outlet filter and a first outlet valve are accommodated in the rotary slide housing.

8. The pumping device according to claim 7, wherein an inlet filter is arranged in the rotary slide housing and/or wherein the outlet filter and the first outlet valve are arranged in the connecting part vertically above the outlet valve or outlet valves.

9. The pumping device according to claim 1, further comprising a driving motor with a driveshaft configured for driving the rotary slide rotor, wherein the driveshaft extends in axial alignment with the axis of rotation.

10. The pumping device according to claim 6, wherein one or more outlet valves are accommodated in the connecting part.

11. The pumping device according to claim 8, wherein a supply line is arranged upstream of the inlet filter.

* * * * *